United States Patent [19]

Hargreaves et al.

[11] 4,066,224

[45] Jan. 3, 1978

[54] KNOCK-DOWN SHIPPING REEL FOR FLEXIBLE CABLE

[76] Inventors: William Hargreaves; Olivia Nancy Hargreaves, both of 224 Old Short Hills Road, Short Hills, N.J. 07078

[21] Appl. No.: 626,132

[22] Filed: Oct. 28, 1975

[51] Int. Cl.[2] ..... B65H 75/22; B65H 75/14

[52] U.S. Cl. ..... 242/115; 242/77.2; 242/118.6; 242/118.7

[58] Field of Search ..... 242/115, 118.6, 118.61, 242/118.62, 118.7, 118.8, 118.4, 118.5, 118.1, 118.2, 118, 118.11, 77, 77.2, 77.3, 77.4, 110, 127

[56] References Cited

U.S. PATENT DOCUMENTS

| | | | |
|---|---|---|---|
| 881,149 | 3/1908 | Pilscheur | 242/127 X |
| 962,654 | 6/1910 | Mossberg | 242/77.4 |
| 1,753,342 | 4/1930 | Hubbard | 242/77.4 |
| 2,096,965 | 10/1937 | Howsam | 242/118.6 |
| 2,304,922 | 12/1942 | Hosfield | 242/118.62 |
| 2,741,442 | 4/1956 | Aupperle | 242/118.6 |
| 3,116,034 | 12/1963 | Randolph | 242/118.61 |

FOREIGN PATENT DOCUMENTS

| | | | |
|---|---|---|---|
| 103,029 | 5/1899 | Germany | 242/77 |
| 903,191 | 4/1962 | United Kingdom | 242/118.6 |

*Primary Examiner*—George F. Mautz
*Attorney, Agent, or Firm*—Hill, Gross, Simpson, Van Santen, Steadman, Chiara & Simpson

[57] ABSTRACT

Knock-down shipping and storage reel for the electric cable, wire rope and fiber rope industries. The reel is constructed to be disassembled when it reaches its destination and the cable or rope has been payed off the reel, and is returned to its shipping point in a knocked-down condition. The reel comprises a pair of parallel spaced flanges or heads, which are fluted for strength when made from metal and have openings extending therethrough concentric with the centers of the reel heads. A spacer tube spaces the flanges apart, concentric with the centers of the reel heads and is detachably secured to each of these reel heads. The carrying media for the cable may comprise circumferentially spaced cables or strands of metal or natural or synthetic fibers, which may be round or generally flat in cross secton. The cables or strands each have metallic terminals at each end, one of which may be a boltlike head. The other end may be threaded to receive a nut, such as a wing nut. Each end of the cable or strand may also be threaded for certain applications. The cables fit through circumferentially spaced holes in the reel heads and serve not only to hold the reel heads in parallel spaced relation with respect to each other, but also serve as a carrying media for the cable to be stored on the reel. Inserts of plastic or wood may be internally recessed to partially conform to the cables, and placed on the cables between the reel heads and retained to the cables and reel heads as tension is taken up on the tensioning cables forming the material carrying media.

10 Claims, 9 Drawing Figures

Fig. 6
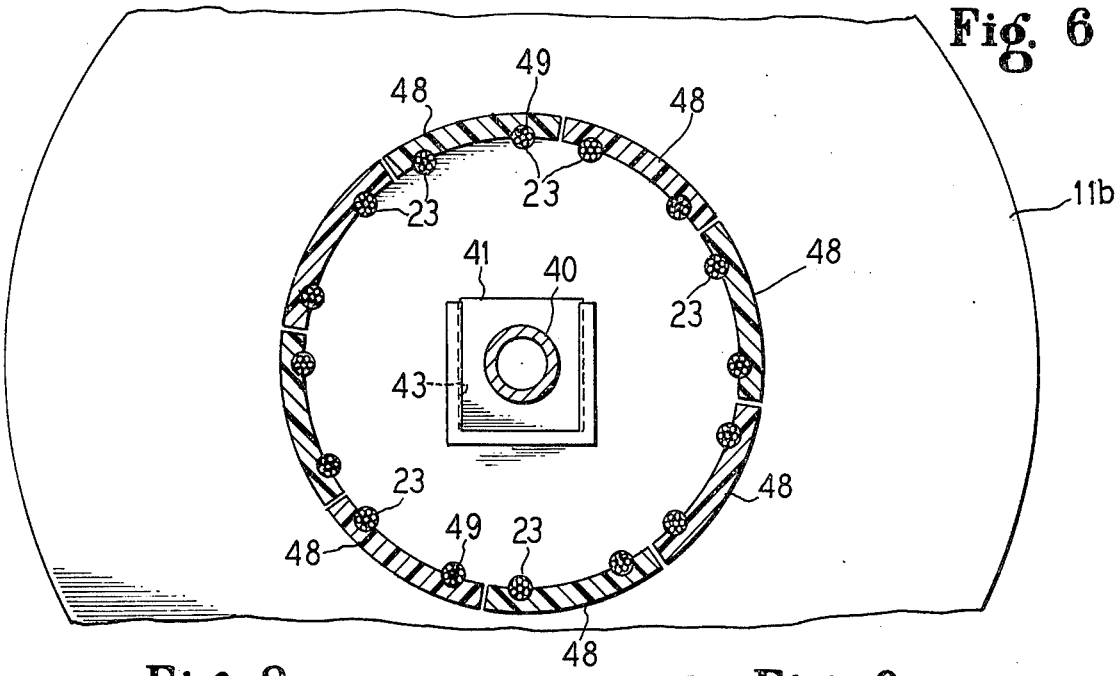
Fig. 8
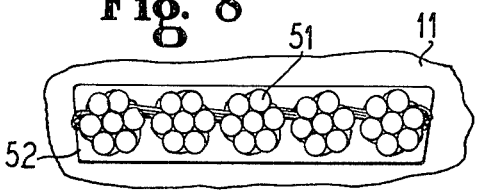
Fig. 9
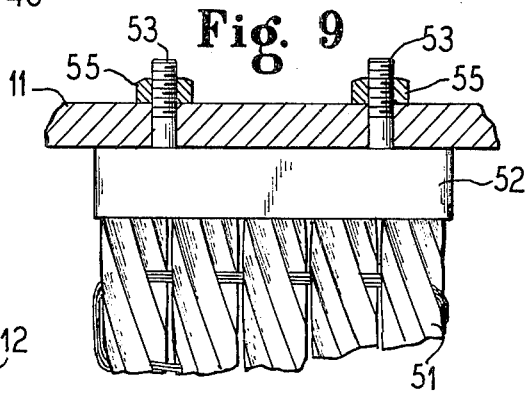
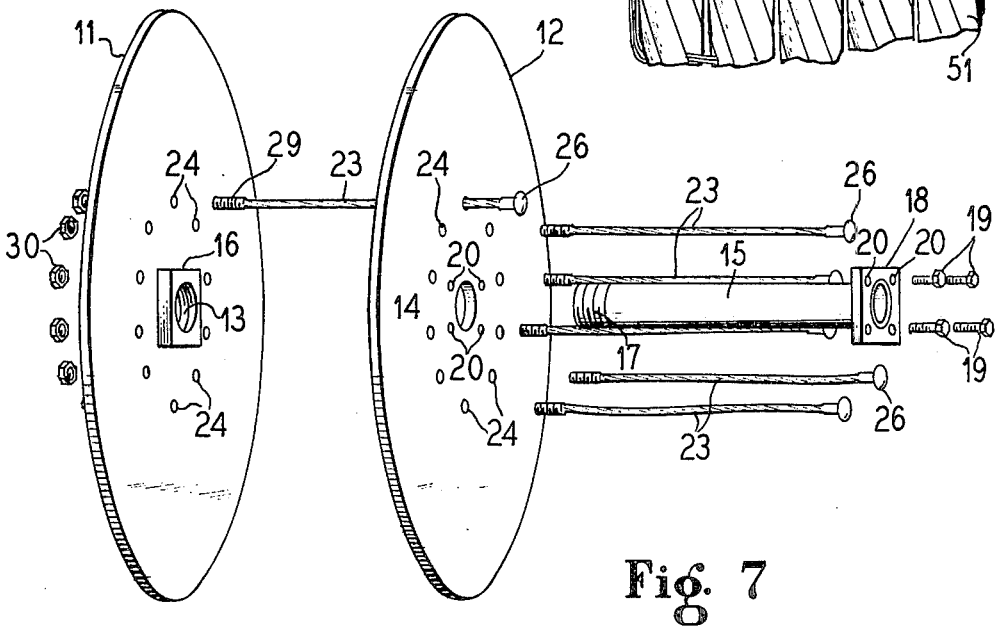
Fig. 7

KNOCK-DOWN SHIPPING REEL FOR FLEXIBLE CABLE

FIELD OF THE INVENTION

Knock-down reel for the shipment of cable, of the type found in Class 242, Subs 115/118.8 and 77.3.

PRIOR ART, BACKGROUND, SUMMARY AND ADVANTAGES OF INVENTION

The U.S. Pat. Nos. to Benson et al 3,827,651; Morris 3,524,604; Aupperle 2,741,442; Tucker, Jr. 2,652,992; MacMillan 2,652,993 and Smith 1,767,710 disclose collapsible or knock-down reels for various types of flexible strands or cable materials some of which reels may be used for shipping, paying off and winding on flexible material, which flexible materials or strands may be in the form of wire rope, electric or steel cables.

The knock-down reel of the present invention is an improvement on the prior art reels mentioned above in that it is of a simpler and lighter construction and may be adapted for heavy electrical cable or wire rope, but which also may be used for fiber ropes of various sizes and materials.

The simplicity and effectiveness of the reel is attained by the connection of the opposite flanges of the reel by a spacer tube and by the utilization of a plurality of circumferentially spaced flexible members to define the barrel of the reel and placed under tension to retain the flanges in parallel relation with respect to each other. The invention also consists in spacing the flexible members circumferentially about the flanges in sets of twos, to form supports for segments of wood, metal or plastic, where the reel is to be used for transporting electrical cable, to prevent damage to the cable by the flexible members.

The advantages of the invention, therefore, are that an effective lighter knock-down reel has been provided than heretofore used which may readily be assembled and disassembled.

A further advantage of the invention is that the effectiveness of the knock-down reel and carrying media for the cable is in the form of flexible members circumferentially spaced and connecting the reel heads or flanges together in a detachable manner.

A still further advantage of the invention is in the connection and assembly of the center spacer tube for the reel to the reel heads, adding rigidity to the flanges and forming a bearing for the drive shaft to the reel, and readily attached and detached from the reel heads.

Another advantage of the invention is that the tensioning members may of themselves define the barrel of the drum and in certain instances, may support segmental inserts placed between the flanges and retained thereto by the taking up of the tensioning members.

A further advantage of the invention is that segmental inserts to form a drum may or may not be used, depending upon the material wound and stored on the reel.

A still further advantage of the knock-down reel is the construction of the reel with a view toward utmost simplicity and efficiency in assembly and disassembly by the use of a center spacer tube and bearing member and flexible tensioning members which may form the barrel for the reel.

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure.

DESCRIPTION OF THE DRAWINGS

FIG. 6 is a sectional view taken substantially along line VI—VI of FIG. 5;

FIG. 7 is a diagrammatic exploded view of the reel, illustrating one manner in which the reel may be assembled;

FIG. 8 is a fragmentary sectional view illustrating a flat flexible material carrying medium formed from a plurality of wire ropes; and FIG. 9 is a partial fragmentary plan view illustrating the mounting of the flat material carrying medium of FIG. 8 on a reel head flange.

DESCRIPTION OF PREFERRED EMBODIMENTS OF THE INVENTION

Figure 1:
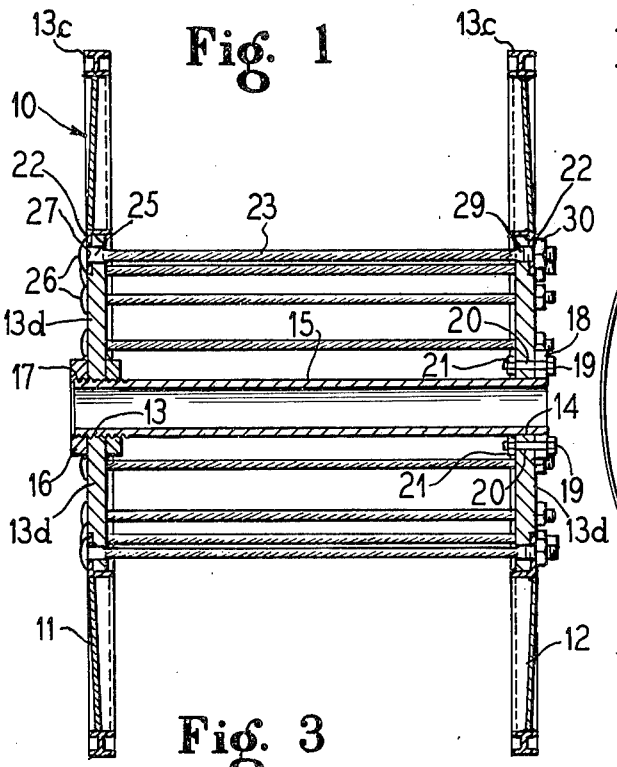
FIG. 1 is a transverse sectional view taken through one form of reel constructed in accordance with the principles of the present invention.
Figure 2:
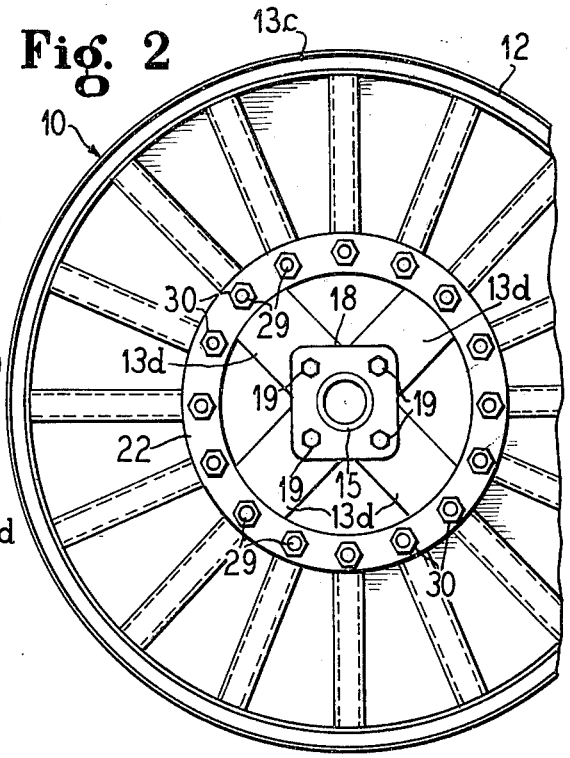
FIG. 2 is an end view of the reel shown in FIG. 1.

In the embodiment of the invention illustrated in FIGS. 1, 2 and 7 of the drawings, we have shown a reel 10 for storing and shipping heavy electric cable, wire rope, fiber cable and the like, comprising two parallel spaced reel heads 11 and 12 in the general form of radial flanges. The reel heads may be made from wood, metal, plastic or any other suitable material and have a circular periphery. As shown in FIGS. 1 and 2, the flanges 11 and 12 are made from thin metal and are fluted for strength and each have an outer peripheral rim 13*c* and radial cross braces 13*d* extending radially inwardly of a flat ring 22 extending about the insides of the flanges. The cross braces of the flange 11 terminate into a concentric threaded portion 13 to receive a threaded end portion 17 of a central spacer tube 15. A boss 16 extends about the threaded portion 17 on the inside and outside of the cross braces and is shown as being internally threaded to receive the threaded end 17 of the spacer tube 15, threaded thereinto during assembly of the reel. The flange 12 is similar to the flange 11 except the cross braces are not internally threaded and are adapted to be abutted by a flange 18 on the end of the spacer tube 15 opposite the threaded end 17 thereof and is shown in FIG. 2 as having a rectangular perimeter, although the perimeter need not necessarily be rectangular. Said flange 18 may be welded or otherwise secured to the spacer tube and may be drilled adjacent the corners thereof to receive through-bolts 19 extending through registered drilled portions of the cross braces. Nuts 21, welded or otherwise secured to the insides of the cross braces may have said through-bolts threaded thereon, to bring and retain the flange 18 into firm engagement with the outer surface of the cross braces 12, and thus retain the heads or flanges 11 and 12 in parallel spaced relation with respect to each other when the threaded end of the spacer tube 15 is threaded in the boss 16. The spacer tube 15, when assembled to the two flanges or reel heads 11 and 12, thus forms a reel having parallel spaced reel heads and movable about or with a shaft (not shown), which may be an idler or drive shaft, for suitably driving the reel when winding cable thereon and paying cable from the reel at a controlled rate.

Where the flanges or heads 11 and 12 are of steel, the boss 16 and nuts 21 may be welded or otherwise secured thereto. Where the flanges are made of wood or any other suitable non-weldable material, the boss 16 may be secured thereto as by through-bolts or other suitable means. The nuts 21 may be threaded on the bolts 19 from the insides of the reel heads in such cases.

Figure 3:
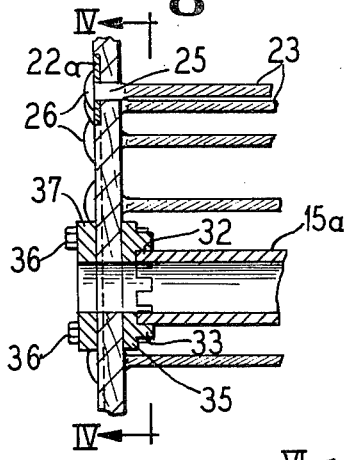
FIG. 3 is a fragmentary sectional view illustrating a modified form in which the center spacer tube may be connected with an end flange for the reel.

FIG. 3 gives an example of a wood reel head. Where the flanges are of wood, an annular plate 22*a* may be recessed in the outside of each flange with its outer face flush with the outer face of the flange, to enable the flanges to withstand the stresses and weight of the carrying medium for the cable.

As shown in FIGS. 1, 2, 3 and 4, the carrying medium for the cable may be a plurality of flexible wire rope cables or strands 23, which may be round or flat in cross section, and while herein shown as being wire rope cables, may also be made from natural or synthetic fibers or any other suitable material. The cables, when wire rope or steel cables, may be coated with P.V.C. (polyvinylchloride) or other suitable plastic material, to reduce any abrasive effect on the cable wound thereon. The wire rope cables 23, as shown in FIG. 1, extend through aligned holes 24 in the rings 22 and cross braces 13*d* of the reel heads 11 and 12 and are circumferentially and radially spaced from and about the spacer tube 15. Said cables 23 are shown as having one end having a terminal 25, which may be connected thereto as by swaging. The terminal 25 is shown in FIG. 1 as having a round head 26, similar to the head of a carriage bolt having a flat engaging surface 27, engaging the flat outer surface of the annular plate 22, as tension is taken up on the flexible cables. The opposite terminals of each flexible cable is shown in FIG. 1 as having a slightly enlarged terminal portion 29 having a nut 30 threaded thereon, to take up tension on the cable and form a carrying medium for wire rope or other material wound on the reel. The cables 23 may be of varying lengths and cross sections, although each cable in each reel is of the same length and cross section, depending upon the material to be carried by the reel.

As shown in the diagrammatic exploded view of FIG. 7, the reel heads are diagrammatically shown as being in the form of annular plates, although they may be fluted. The spacer tube 15 may be passed through the bores 14 and 13 of the reel heads 11 and 12 and threaded in the threaded boss 16, until the spacer tube 15, boss 16 and flange 11 are tightly located with respect to each other. The flange 12 may then be rotatably moved about the spacer tube to align the holes 20 for the bolts 19 with the corresponding bolt holes in the flange 18 at the end of said spacer tube opposite its threaded end. The bolts 19 may then be placed in the proper bolt holes and threaded on the nuts 21 to firmly attach the flange 12 to the spacer tube 11 and form a reel having parallel spaced reel heads 11 and 12 in firm spaced relation with respect to each other, with the circumferentially aligned holes 24 in the flat rings 22 (not shown in FIG. 7) of the reel heads 11 and 12 aligned to receive the flexible cables 23.

Figure 5:
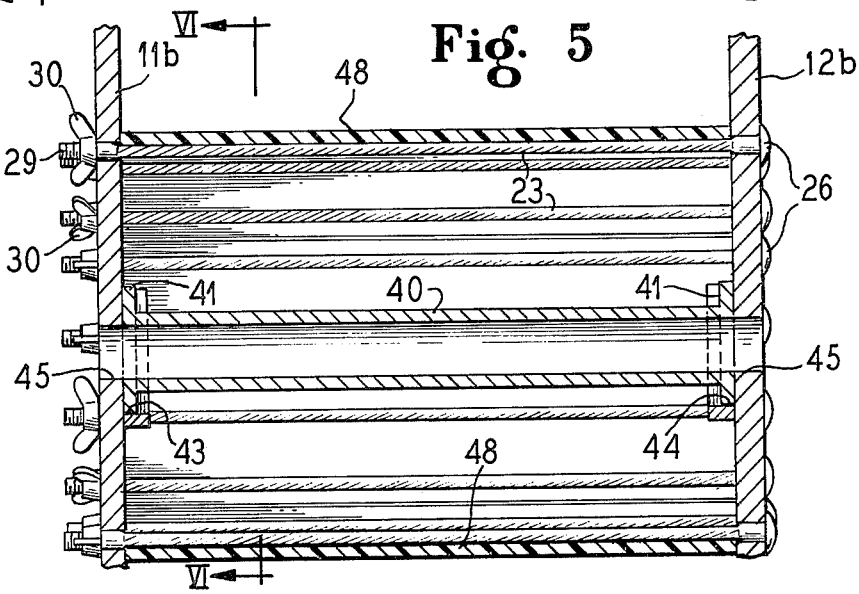
FIG. 5 is a transverse sectional view illustrating another modified form in which the reel may be constructed, and showing segmental inserts supported on the flexible tensioning members.

The flexible cables or carrying media 23 may then pass through the aligned holes 24 in the flat rings 22 of the reel heads 11 and 12, and the nuts 30 may be threaded on the threaded terminals thereof to bring the inner plane surfaces 27 of the rounded heads 26 of the carrying media into engagement with the head or annular ring 22. The nuts 30 may be hex nuts or wing nuts, as shown in FIG. 5, and also may be of various other commercial forms adapted to be quickly tightened by power torsion wrenches or other tools.

In dismantling the reel, tension should first be taken off the carrying media or cables 23 by loosening the nuts 30 until slack is formed in the cables. The four bolts 19 may then be removed to free the head 12 to be slid along the center tube 15 and flexible cables 23 toward the flange 11. The two heads may then be held by hand and the spacer tube 15 rotated to unscrew said spacer tube from the threaded boss. The end of the spacer tube 15 may then be lifted manually or by a crane or other lifting device to lift the spacer tube 15 from the two heads 11 and 12 and accommodate the free head 12 to rest on top of the head 11. The reel is then ready for return transportation in a knocked-down form. If desired, the flexible carrying media 25 may also be removed to increase the compactness of the reel for shipment to its return destination.

Figure 4:
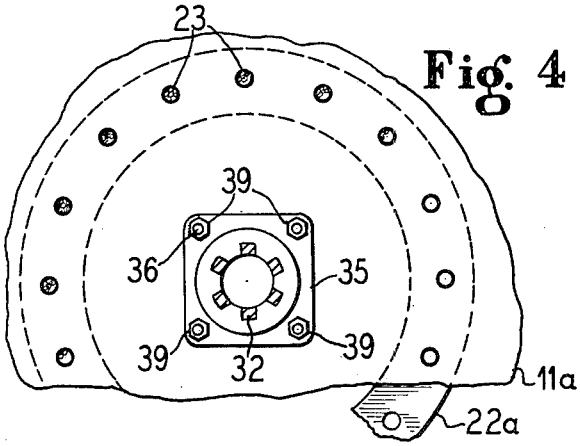
FIG. 4 is a fragmentary end view of the reel shown in FIG. 3.

In FIGS. 3 and 4, we have shown a modified form of center spacer tube 15*a*, similar to the spacer tube 15, but having a castellated end portion 32 fitting in a corresponding castellated end portion 33 of a hub 35, shown as being secured to an end flange 11*a*, as by machine screws 36 passing through a metallic flange 37 abutting the outside of the flange or reel head 11*a* and threaded in the hub 35. It is to be understood that said machine screws may be bolts and may pass through said hub 35 and be secured thereto as by nuts 39, threaded on the ends thereof passing through the hub 35, as shown in FIG. 4.

The reel shown in FIGS. 3 and 4 is otherwise like the reel shown in FIGS. 1, 2 and 7, but has wood flanges or heads reinforced on their outsides by annular rings 22*a* recessed in said flanges and through which the carrying media or cables 23 pass, as shown in FIGS. 1, 2, 3 and 4.

In the form of the invention just described, the reel is assembled by registering the castellated end of the tube 15 with the castellated portion of the hub 35 after the spacer tube has passed through the central apertured portion of the reel head 12. The opposite end of the tube 15 may have a flange like the flange 18 welded or otherwise secured thereto and abutting the outside of the opposite reel head and secured thereto as by the through-bolts 19 threaded on the nuts 21.

The modification of the invention illustrated in FIGS. 5 and 6 shows a central spacer tube 40 having a rectangular flange 41 at each end thereof, which may be welded or otherwise secured thereto or may be formed as an integral part thereof. The rectangular flanges 41 may fit within locating slots 43 on the insides of reel heads 11*b* and 12*b* and opening toward the center of the reel and generally channel-like in end elevation, and having right-angled inner faces in the general form of angle irons. Said locating slots form locating channels to locate the center of the spacer tube concentric with central openings 45 of the reel heads or flanges 11*b* and 12*b*.

In this form of the invention, the center spacer tube 40 is placed in the channeled locating slots 43 and 44 to space the two reel heads apart in parallel relation with respect to each other. The carrying media 23 may be cables, as in the form of the invention shown in FIGS. 1 through 4, which are spaced circumferentially in spaced-apart pairs as shown in FIG. 6. That is, each closely spaced pair of cables supports the adjacent ends of annular segmental inserts 48 forming a cylindrical drum, when placed on the carrying media. The segmental annular inserts may be made from wood, plastic or any other suitable material and have recessed portions 49 adjacent opposite ends thereof to be received by the cables 23 and retained thereto upon tightening of the wing nuts 30, placing sufficient tension on the flexible cables, to retain the inserts between the flanges or heads of the drum, to form a cylindrical drum, particularly adapted for the reeling of heavy insulated electric cable thereon, which may otherwise be damaged if wound directly on the flexible material carrying cables 23.

While the segmental inserts are shown in the modification having a center spacer tube having flanges at each end thereof, and fitting in channeled locating slots on the insides of the drum flanges, it should be understood that the segmental inserts may also be placed on the material carrying media in the forms of the invention shown in FIGS. 1 through 4. In such cases, however, the flexible cables should preferably be spaced apart in pairs to support the inserts adjacent their opposite ends, as shown in FIG. 6.

While the reel heads **11*b* and 12*b* in FIGS. 5 and 6 are shown as being in the form of flat annular plates, it should be understood that they need not be annular plates, but may be fluted as in the form of the invention shown in FIGS. 1 and 2 with annular rings recessed therein to take the stresses of the cables 23**.

In FIGS. 8 and 9, we have shown a fragmentary view in which a material carrying medium 51 is generally flat in cross section, and while preferably formed from wire ropes stitched together and made from steel, or other metals, may be made from natural or synthetic fibers. Where made from steel or metal, the ropes may be coated with P.V.C. (polyvinylchloride), or any other suitable plastic material, to reduce any abrasive effect of the material carrying media on the cable wound thereon. The flat material carrying medium 51 in these two figures is preferably made from wire ropes stitched together and having terminals 52 at opposite ends thereof having threaded studs 53 extending therefrom through the respective reel heads 11 and 12, and retained thereto as by nuts 55 threaded on the ends of said studs.

The reel may otherwise be constructed as in the forms of the invention illustrated in FIGS. 1 through 6 of the drawings and may be assembled in a manner similar to that diagrammatically shown in FIG. 7, where the end of the tube 15 is threaded in a threaded boss 16.

It shoud be understood that as the reel is being assembled and the reel heads 11 and 12 are secured to the spacer tube 15 and the flexible carrying media are passed through the registering holes or apertured portions of the reel heads and reinforcing rings therefor that the nuts 30 may be tightened by a torque wrench to a predetermined load, which may be approximately one-third the breaking load of the material carrying media. The reel, after assembly, may be marked with a direction arrow and a reel driving lug (not shown) may be located on the reel head 12 having the four bolt holes 20 leading therethrough.

It should further be understood that when disassembling the reel, except in the form of the invention illustrated in FIGS. 8 and 9, the material carrying media need not necessarily be removed from the reel heads 11 and 12, but may be retained to said reel heads and pass beyond the ends of opposite reinforcing rings or beyond the end of one reel head and flexed to reduce the width of the reel or may be completely removed from each reel head and bundled together and tied to the removed center spacer tube and to the associated reel heads for return to the origin of shipment of the loaded reels.

We claim as our invention:

1. A knock-down reel for flexible cable and the like, comprising:

a pair of spaced flanges forming reel heads, each of said reel heads having an opening concentric with the center thereof, a spacer tube concentric with said openings and connected between said flanges to space said flanges apart and form a bearing for the reel, spaced flexible members maintained under tension, and equally spaced radially outwardly of the center of said tube, individual means for each flexible member and accessible from the outside of at least one of said reel heads for maintaining said flexible members under tension and said flanges in parallel spaced relation with respect to each other, and segmental inserts mounted on said flexible members between said reel heads and carried by said flexible members and maintained to said flexible members by the compressive force of said flanges as tension is taken up on said flexible members.

2. The knock-down reel of claim 1, wherein the segmental inserts are recessed to fit on said flexible members and are carried by said flexible members between said reel heads to form a continuous cylindrical drum, and are maintained on said flexible members by the compressive force of said reel heads as tension is taken up on said flexible members.

3. The knock-down reel of claim 1, in which the flexible members are relatively flat in cross section and each include a plurality of flexible cables stitched together, and having parallel terminals extending from opposite ends thereof adapted to be secured to said reel heads.

4. The knock-down reel of claim 1, in which an annular flat member is recessed in at least one of said reel heads and forms a bearing means for the means taking up tension on the flexible members.

5. A knock-down reel for flexible cable and the like, comprising:

a pair of spaced flanges forming reel heads, each of said reel heads having an opening concentric with the center thereof, a boss on at least one of said reel heads defining a spacer tube receiving opening, a spacer tube, means on said spacer tube to interengage one end portion of said spacer tube and other means retaining the spacer tube to the other reel head to extend through the spacer tube receiving opening therein, said boss being internally threaded and said spacer tube being externally threaded and the end of said spacer tube opposite the threaded end thereof being flanged, and means to secure a flanged portion of the spacer tube to the associated reel head, spaced flexible members maintained under tension and defining the barrel of said reel and spaced radially outwardly of the center of said tube in circumferentially spaced relation with respect to each other, and forming a load carrying media, and individual means for each flexible member and accessible from at least one of said reel heads for maintaining said flexible members under tension and said flanges in parallel relation with respect to each other.

6. The knock-down reel of claim 5, in which an annular flat member is recessed in at least one of said reel heads and forms a bearing means for the means taking up tension on the flexible members.

7. A knock-down reel for flexible cable and the like, comprising:

a pair of spaced flanges forming reel heads, each of said reel heads having an opening concentric with the center thereof, a spacer tube concentric with said openings and connected between said flanges to space said flanges apart and forming a bearing for the reel, spaced flexible members maintained under tension and defining the barrel of said reel and spaced radially outwardly of the center of said spacer tube in circumferentially spaced relation with respect to each other, and forming a load carrying medium, individual means for each flexible member and accessible from the outside of at least one of said reel heads for maintaining said flexible members under tension and said flanges in parallel spaced relation with respect to each other, said spacer tube having opposite flanged ends and channeled guides formed on the inside of each reel head flange to receive the flanged ends of said spacer tube and mount said spacer tube concentric with the openings extending through said reel heads, said flanged ends of said spacer tube being secured to said channeled guides and reel heads by the taking up of tension on said flexible members.

8. The knock-down reel of claim 7, including segmental inserts mounted on said flexible members and retained thereto by the taking up of tension on said flexible members, and the compressive force on the ends of said inserts exerted by said reel head flanges.

9. The knock-down reel of claim 8, in which the flexible members are circumferentially spaced in pairs of two to support each insert on two widely spaced flexible members throughout the circumference of the drum formed by said flexible members.

10. The reel head of claim 9, wherein the segmental inserts have recessed inner end portions fitting on said flexible members and retaining said inserts in position thereon in cooperation with the compressive forces exerted on the ends of said inserts by said reel heads.

* * * * *